United States Patent [19]

Leahy

[11] Patent Number: 4,579,537

[45] Date of Patent: Apr. 1, 1986

[54] TAKE-APART TOY

[76] Inventor: Lynne Leahy, 1940 W. University Dr., Mesa, Ariz. 85201

[21] Appl. No.: 608,484

[22] Filed: May 9, 1984

[51] Int. Cl.[4] ..... A63H 3/16

[52] U.S. Cl. ..... 446/100; 446/99

[58] Field of Search ..... 446/99, 97, 98, 369, 446/320, 371, 376, 85, 108, 109, 119, 100

[56] References Cited

U.S. PATENT DOCUMENTS

| | | | |
|---|---|---|---|
| 1,620,574 | 3/1927 | Savage | 446/85 |
| 1,828,765 | 10/1931 | Crist | 446/371 |
| 3,009,235 | 11/1961 | de Mestral | 28/78 |
| 3,083,737 | 4/1963 | de Mestral | 139/46 |
| 3,147,528 | 9/1964 | Erb | 24/404 |
| 3,154,837 | 11/1964 | de Mestral | 28/72 |
| 3,462,877 | 7/1969 | Lang | 46/159 |
| 3,854,239 | 12/1974 | Williams | 46/126 |
| 3,953,030 | 4/1976 | Muchnick | 273/95 |
| 4,075,782 | 2/1978 | Neuschatz | 46/118 |
| 4,094,093 | 6/1978 | Kaelin | 46/160 |
| 4,107,870 | 8/1978 | Ausnit | 46/28 |
| 4,113,251 | 9/1978 | Imes, Jr. | 273/95 |
| 4,122,628 | 10/1978 | Crowell et al. | 46/135 |
| 4,166,618 | 9/1979 | Sheem | 273/96 |
| 4,197,670 | 4/1980 | Cox | 46/153 |
| 4,208,832 | 6/1980 | Corriveau | 446/369 X |
| 4,249,337 | 2/1981 | Edson | 46/153 |
| 4,259,807 | 4/1981 | Silverstein | 46/161 |
| 4,273,275 | 6/1981 | Vadnais | 224/101 |
| 4,280,292 | 7/1981 | Hills | 40/538 |
| 4,288,222 | 9/1981 | Kling | 434/272 |

FOREIGN PATENT DOCUMENTS 566160 9/1975 Switzerland .

*Primary Examiner*—Mickey Yu

*Attorney, Agent, or Firm*—Gerry J. Elman

[57] ABSTRACT

A toy which can be taken apart and reassembled serves as both a soft, cuddly doll and a puzzle. It consists of six stuffed, fabric-covered components of generally uniform thickness that abut one another in a common plane. From the front and back, the assembled components create a two-dimensional view of a fanciful human or animal figure. The components are detachably joined at their abutting edges by Velcro fastening tape or the like. To keep the doll assembled during play, the components are secured in place by reinforcing supports. One end of each support is sewn to one of the components of the doll. The free end of each support is provided with a patch of male Velcro material placed to cover (and fasten to) a corresponding patch of female Velcro material on another component of the doll. The components, with their corresponding supports, are covered and decorated with various fabrics and simulated hair or fur to look like clothed, fanciful humanoid characters. The head (and any hat) is represented by three of the components; the body, arms and legs are represented by the other three. Some or all of the character's facial features may be represented by decoration on the supports for the elements representing the head. Additional components having different fabrics, shapes or facial features from that of the original doll may optionally be provided to simulate changing the doll's clothes or identity by interchanging the new component or components with the doll's corresponding original components.

20 Claims, 9 Drawing Figures

TAKE-APART TOY

BACKGROUND

1. Field of the Invention

The present invention relates to toys and in particular to soft human and animal figures which can be taken apart and put back together as a puzzle.

2. The Prior Art

The two-component fastening system used in the preferred embodiments of this invention is sold by the Velcro Manufacturing Company of Manchester, New Hampshire under the trademark Velcro. Similar fastening material is sold under the trademarks Scotchmate and Mastex. More specific information about the Velcro fastening system may be obtained from the literature, e.g., U.S. Patent Nos. 2,717,437 and 3,114,951. As is known, this fastening system employs a pair of complementary elements. The first element (male) is a tape, i.e., a strip of fabric, from which of a multiplicity of tiny plastic hooks project, and the second (female) is a corresponding strip from which a multiplicity of tiny plastic loops similarly project. The two elements are adapted to be releasably secured by mere contact with each other. To that end, when the components are brought into contact with each other, many of the hooks of the male element engage many of the loops of the female element. When so secured, the two elements can be readily separated just by pulling them apart.

Figure toys, e.g. dolls, employing a fabric tape fastening system are described in various patents including:

| | | |
|---|---|---|
| 3,854,239 | Williams | 12/17/74 |
| 4,075,782 | Neuschatz | 2/28/78 |
| 4,122,628 | Crowell et al. | 10/31/78 |
| 4,228,222 | Kling | 9/8/81 |
| 4,249,337 | Edson | 2/10/81 |
| 4,280,292 | Hills | 7/28/81 |

SUMMARY OF THE INVENTION

The present invention provides a family of new and useful figure toys. Although generally referred to herein as "dolls" it is to be understood that the present invention includes wide variation in the figures that may be represented by these toys, e.g. strictly human, or animal, or (as preferred embodiments) fanciful humanoid with some animal-like characteristics. Indeed, without departing from the spirit of the present invention, inanimate objects may be similarly depicted. Each such toy is constructed to be cuddled and played with as a doll and also to be capable of being repeatedly disassembled and reassembled as an educational puzzle.

A child or other person who takes apart and reassembles the doll receives significant educational benefits. The player is encouraged to match corresponding materials, fit pieces together, and to recognize where different parts of the body go. When the doll is completely assembled, the player gains a sense of accomplishment and is rewarded by playing with a lovable, cuddly stuffed doll.

The components of the present invention are all pillow-shaped that is, they have two major dimensions (height and width) and one minor dimension (thickness, which is generally uniform). When assembled into preferred embodiments of the their invention, front and back views form fanciful creatures. The side view, however is not significantly representative of a creature, but rather is more or less flat, like a gingerbread man viewed edgewise with supports as described below.

The components are attached to each other at flat edges in the thickness dimension so that they fit snugly without obvious gaps. At each such interface, one component is finished with a strip of male fastening tape and the other component is finished with a corresponding strip of female fastening tape. Because the pieces fit tightly together in this manner, and each component relates through design to the piece below, beside and/or above it, the assembled doll avoids looking awkward and disjointed and instead presents a pleasing look of oneness, despite its really being an assembled puzzle.

Each component is filled with soft stuffing and covered in fabrics or other material that look like part of the object it is intended to represent. When assembled and joined together at their edges, the components form a recognizable object.

These components are held together not only at their contiguous edges, but are further secured with reinforcing supports overlaid across two or more components. In preferred embodiments of the invention, each support is anchored at one end, as by sewing, to one of the components. On the underside of the support, one or more patches of fastening tape are provided to mate with corresponding patches of fastening tape provided for this purpose on the surface of one or more of the other components. By such mating patches of fastening tape, such as Velcro material, the support is detachably secured to the other component or components as well, helping to hold the assembled doll rigidly together.

The supports are designed to be overlaid across one or more of the interfaces between components. Each support is preferably finished with materials corresponding to those on the component immediately underlying the support. In addition, special decoration may be provided on the supports. Where it passes over components representing the face, for example, a support may also carry representation of one or more facial features, e.g. the mouth, the nose or an eye.

The supports connect the components and help give the doll rigidity and firmness. They can be in the form of strips running horizonally, vertically, or obliquely, or may be in the form of recognizable shapes such as nose or mouth. They are preferably on both the front and the back of the doll components.

In preferred embodiments of this invention, each doll is constructed from six components, of which three form the head, along with a hat, if any, and the other three form the limbs and torso. In male dolls, e.g. a man or boy, the legs are formed by two components, and the doll is completed by a single component representing the torso and arms. In female dolls, e.g. a woman or girl, a single component represents a skirt and the feet, another component represents the left arm and left side of the torso, and yet another the right arm and right side of the torso.

Alternatively, one could increase or decrease the complexity of the puzzle by constructing dolls having fewer or more components than six. Also, using six components, within the broad concept of this invention, one could decrease the number of elements making up the face and increase the number of elements representing various parts of the torso and limbs. However, because so much recognition is centered on facial characteristics, it is preferred that the face be constructed from about half of the total number of components. It is also within the overall spirit of the invention to construct inanimate objects which can similarly be taken apart and reassembled.

THE DRAWINGS

DESCRIPTION OF PREFERRED EMBODIMENTS

1. Adult Male Doll

Figure 1:
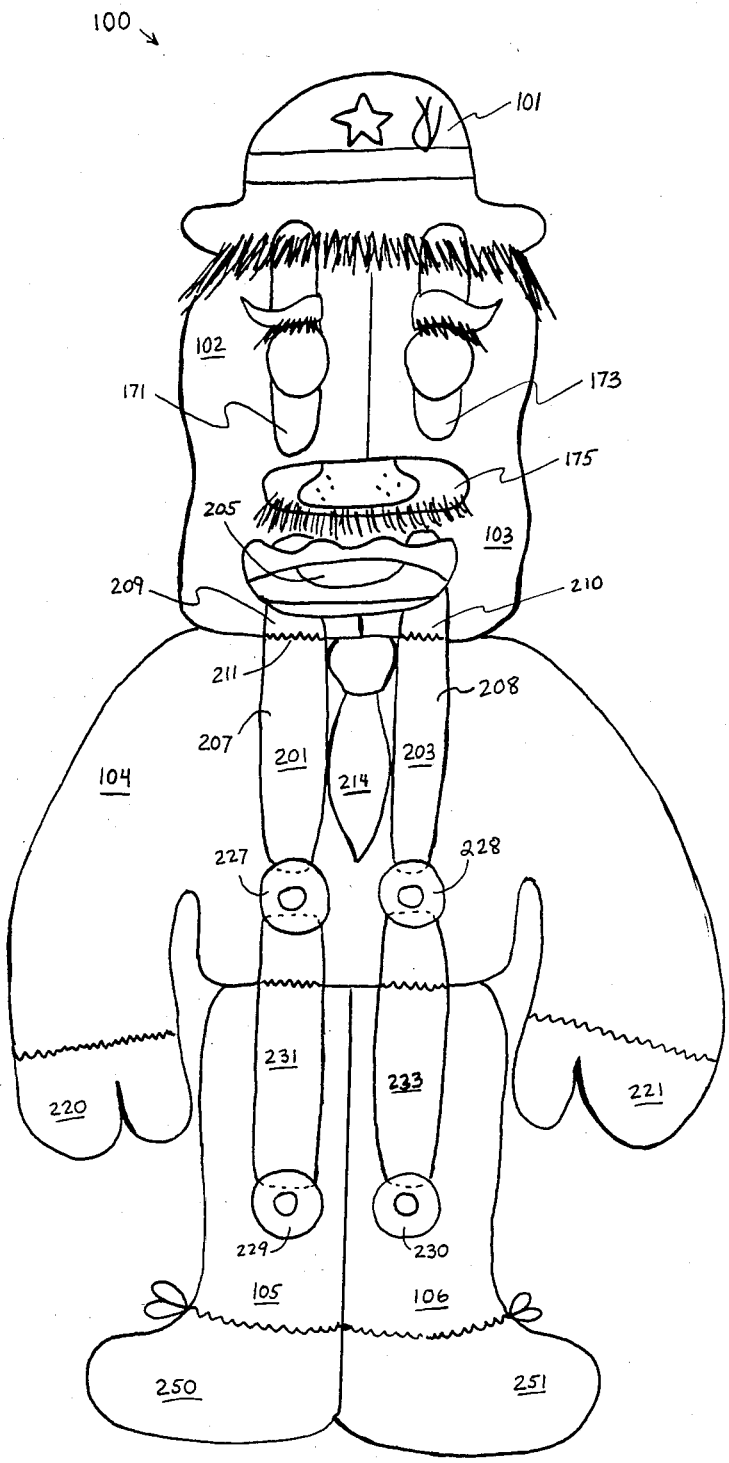
FIG. 1 is a front view of a doll representing a fanciful adult male character in accordance with the invention.
Figure 2:
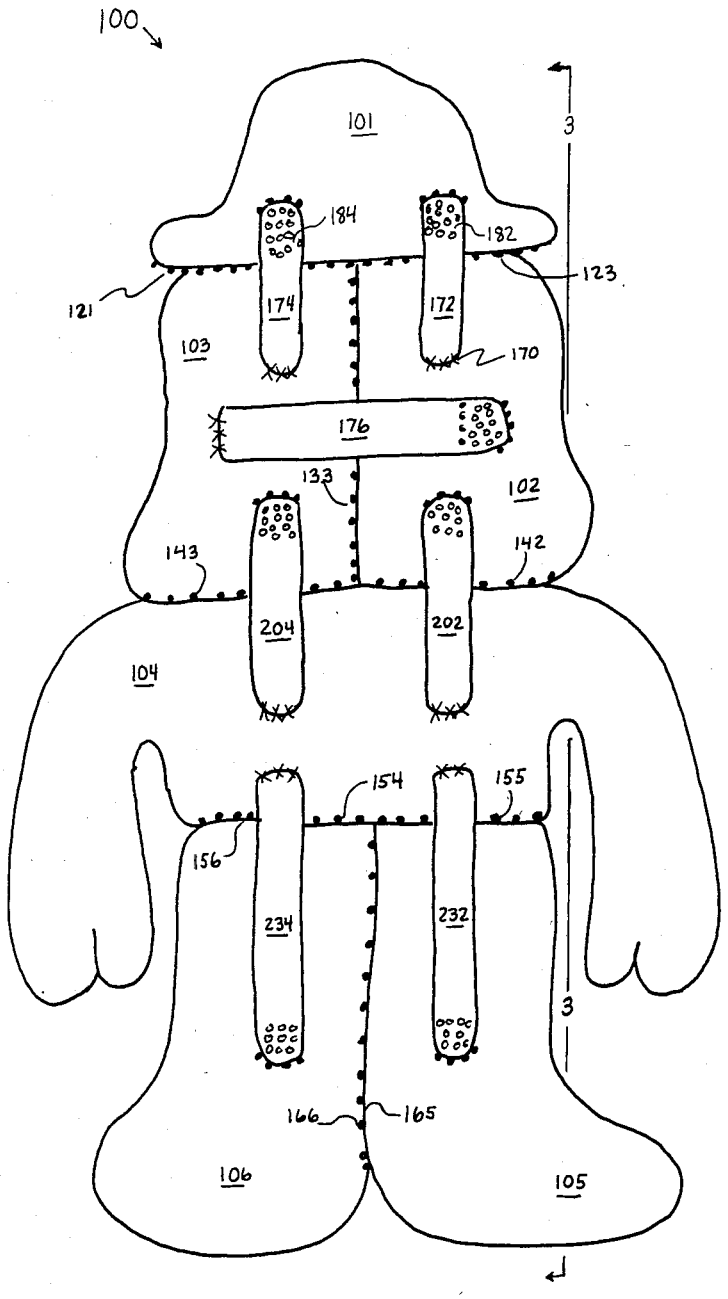
FIG. 2 is a back view of the doll of FIG. 1, in which the features of construction are emphasized, figuratively representing female fastening tape as a series of dots.
Figure 3:
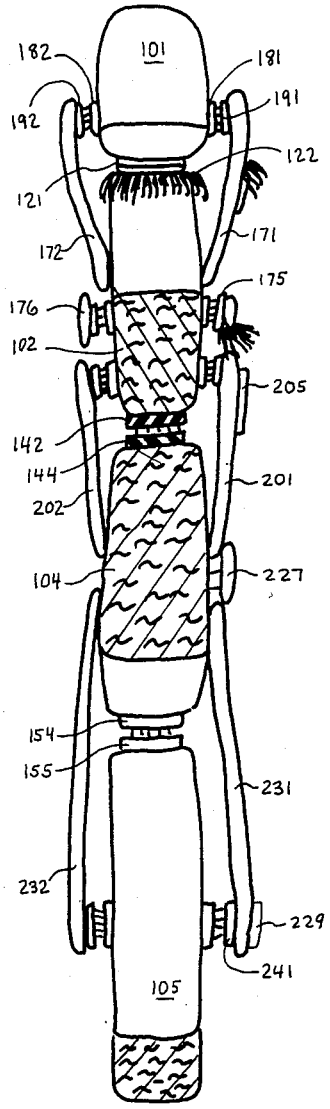
FIG. 3 is a side partially sectional view of the doll of FIGS. 1 and 2 taken through line 3—3.

As shown in FIGS. 1 to 3, a doll 100 embodying a preferred version of the present invention, depicting an adult male humanoid character, consists of six detachable stuffed fabric components 101, 102, 103, 104, 105 and 106. A hat component 101 abuts and is detachably secured to both a right face component 102 and a left face component 103 by female fastening tape 121 on its bottom surface, which adheres to male fastening tape 122, 123 on the top surface of the face components 102, 103. The face components 102 and 103 are detachably secured to each other by male fastening tape (not shown) on the left vertical surface of right face component 102, which adheres to female fastening tape 133 (schematically illustrated in FIG. 2 as a row of dots) on the right vertical surface of left face component 103.

Each of the face components 102, 103 is detachably secured to a torso component 104 by female fastening tape 142, 143 which adheres to male fastening tape 144 on the top surface of the torso component 104.

The torso component 104 is detachably secured to right and left leg components 105, 106 by female fastening tape 154 on the bottom surface of torso component 104 which adheres to male fastening tape 155, 156 on the top surface of leg components 105, 106.

The leg components 105, 106 are detachably secured to each other by male fastening tape on the left vertical surface of right leg component 105 which adheres to female fastening tape 166 on the right surface of left leg component 106.

The six-component doll described so far would be unusable for play because the components would separate from each other when twisted or pulled. In accordance with the present invention, a series of strap-like supports hold the doll together during play, overlying the front and back surfaces of the doll. Preferably one end of each support is permanently attached, i.e. sewn, to one of the components of the doll. The free end of each support is faced with a patch of fastening tape, e.g. male, which is detachably secured to a corresponding patch of fastening tape, e.g. female, on the body component to which it is designed to be secured.

The supports are preferably of rigid or semirigid material, e.g. plastic or leather, and are desirably covered or faced with fabric corresponding to that of the body components which they overlie. When there is a difference in fabric color or texture between different components, different portions of the supports desirably are covered with fabric corresponding that of to the body components which they overlie. Thus the supports also serve to camouflage the joints between body components and thereby assist the eye to perceive the assembled doll as a unified whole.

The supports also may carry additional design or decorative elements of the doll, such as facial features. Such an arrangement enhances the puzzle quality of the toy, since the eyes, nose and mouth are not in their usual positions on the unassembled components.

In the man doll embodiment shown in FIGS. 1 to 3, the hat component 101 is further secured to the face components 102, 103 by a front right support 171, a back right support 172, a front left support 173, and a back left support 174, the bottom end of each being sewn to the underlying component as illustrated by X's, e.g. at 170.

As shown in FIGS. 2 and 3, the hat component 101 carries patches of female fastening tape 181, 182, 183, 184 sewn or glued to positions abutting the upper termini of the supports 171, 172, 173 and 174, which supports carry corresponding patches of male fastening tape 191, 192, 193, 194. When the doll is assembled, with supports 171, 172, 173 and 174 in position, the patches of fastening tape are not visible (though patches 182 and 184 are represented in FIG. 2 for illustrative purposes).

The lower portions of front supports 171, 173 are covered with fabric corresponding to that of the face components 102, 103 and are finished with representations of eyes, eyelashes, eyebrows and hair. The very top portions of front supports 171, 173 which extend above the hairline are finished to match the hat component 101, which they overlie.

Extending horizontally from left face component 103 to right face component 102 are supports 175 and 176. The front support 175 is covered with fabric matching that of the face components 102, 103 and finished with representations of a nose and mustache. Each of the supports is provided with a patch of fastening tape to mate with a corresponding patch on face component 102.

Supports 201 and 202 are anchored to the torso and extend to the front and back, respectively, of right face component 102; and supports 203 and 204 extend from the torso to the front and back, respectively, of left face component 103. Each is provided with a patch of fastening tape where it overlies a corresponding patch on a face component. The lower portions 207, 208 of the front supports are covered with fabric matching that of the torso 104, and the upper portions 209, 210 of the front supports are covered with fabric matching that of the face components 102, 103. The interface between two fabrics is shown in FIG. 1 by a jagged line, e.g. at 211, but is not represented in FIG. 2 so as not to obscure the features of construction.

Secured near the top of front supports 201 and 203 and extending between them is a representation of the figure's mouth 205. The torso also carries the representation of a necktie 214.

The figure's hands 220, 221 are desirably finished in a fabric (or fake fur) corresponding to that of the face components 102, 103. Buttons 227, 228, 229, 230 may provide additional decoration and camouflage.

Anchored to the torso component 104 beneath buttons 227 and 228 are supports 231 and 233, which extend respectively to the right and left leg components 105 and 106. Buttons 229 and 230 decorate the free ends of supports 231 and 233, which otherwise function as do the other supports to carry patches of fastening tape 241, 242 which detachably secure the supports to the respective leg components 105, 106. Shoes 250, 251 are integral with their respective leg components 105, 106 but are desirably finished with a fabric different from that covering the legs.

2. Adult Lady Doll

Figure 4:
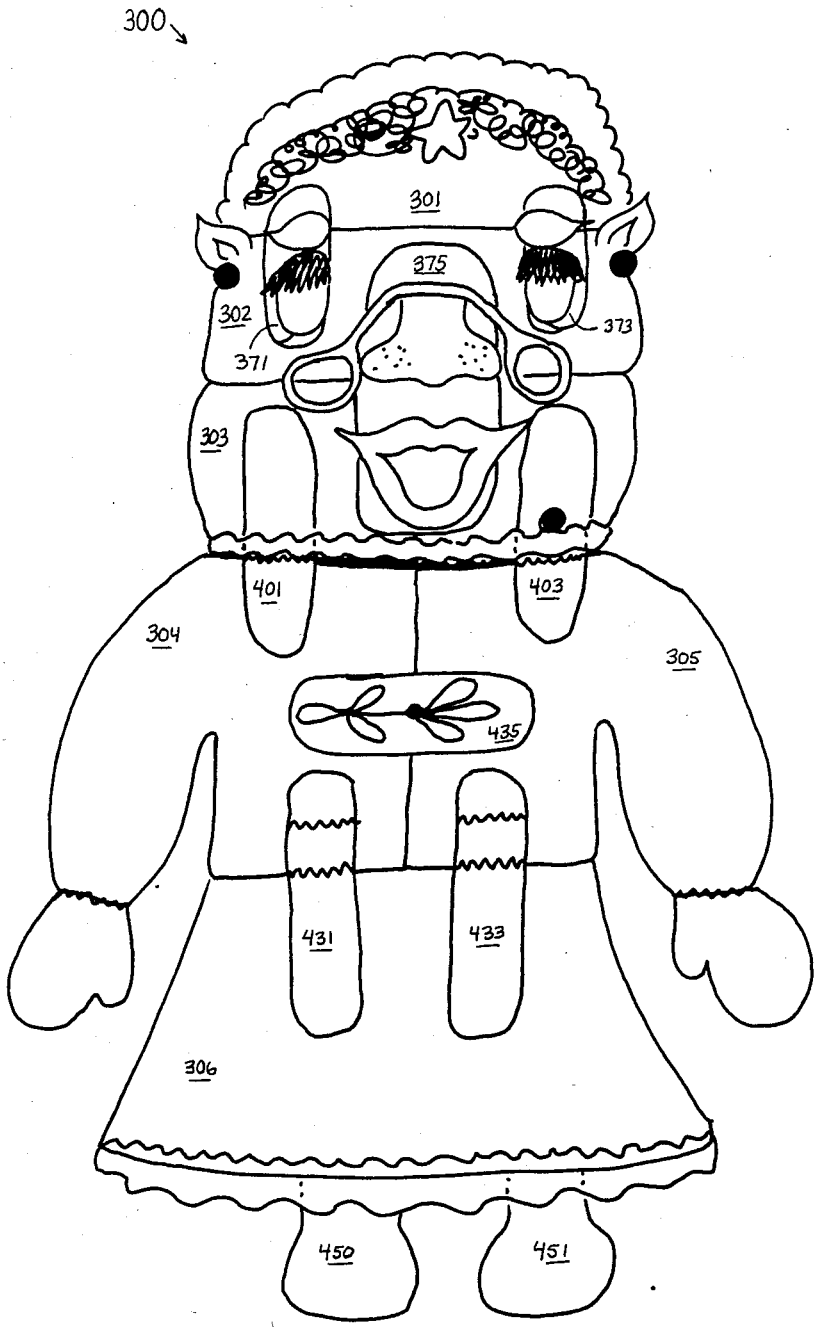
FIG. 4 is a front view of a doll representing a fanciful adult female humanoid character in accordance with the invention.
Figure 5:
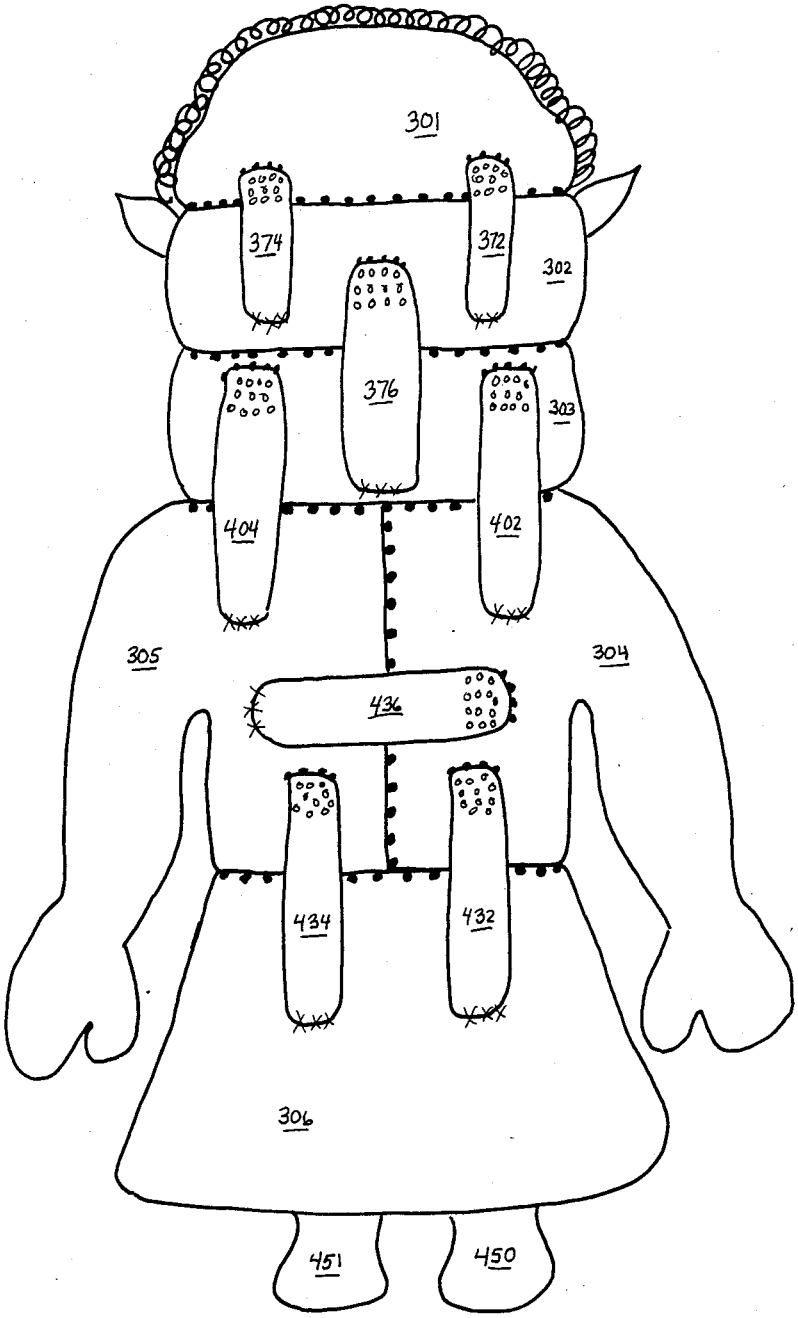
FIG. 5 is a back view of the doll of FIG. 4, depicted in the style of FIG. 2.

As shown in FIGS. 4 and 5, a doll 300 in accordance with the present invention depicting an adult female humanoid character, consists of six components 301, 302, 303, 304, 305, 306, which are similar in overall construction and detail to the previously described components of male doll 100. Each surface of the components which abuts a surface of another component of the character is similarly finished in fastening tape of a type complementary to that of the component which it abuts, so that the components are detachably secured on contact. And the components are secured to each other by appropriately finished supports, secured at one end to a front or back surface of a component and provided at the loose end with a patch of fastening tape adapted to mate with a complementary patch on the other component.

However, although the head of the female character 300 is composed of three elements 301, 302, 303 just as does the head of male character 100, the elements are in a different configuration. The head of the female character 300 comprises a brow component 301, a cheek component 302, and a chin component 303, arranged from top to bottom in abutment.

Similarly the lower portion of the female character 300 comprises three component 304, 305, 306, just as does the lower portion of the male character 100. However, instead of a torso component 104 as in the male character 100, the female character 300 has a right torso component 304 and a left torso component 305. Instead of two leg components 105, 106, the female character 300 has a single skirt component 306 which includes a pair of feet 450, 451.

Because the body components of female character 300 are configured differently from those of male character 100, the supports are also different in location and in number. Supports 371, 372, 373, 374 are secured to the cheek component 302, as by stitching and are adapted to be releasably secured to patches of fastening tape on the brow component 301. The front supports 371 and 373 are decorated with eyes, eyelashes and eyebrows.

Supports 375 and 376 are secured to the chin component 303 and are adapted to be releasably secured to the brow component 302. The front support 375 is decorated with a nose and mouth of the character.

The torso components 304, 305 are secured to the chin component 303 by supports 401, 402, 403, 404. The left and right torso components 304, 305 are secured to each other by supports 435, 436 extending horizontally over the interface between the torso components. The front strap 435 is affixed to the right torso component 304, and the back strap 436 is affixed to the left torso component 305. The free end of each support is detachably secured to the other torso component by fastening tape.

3. Girl Doll

Figure 6:
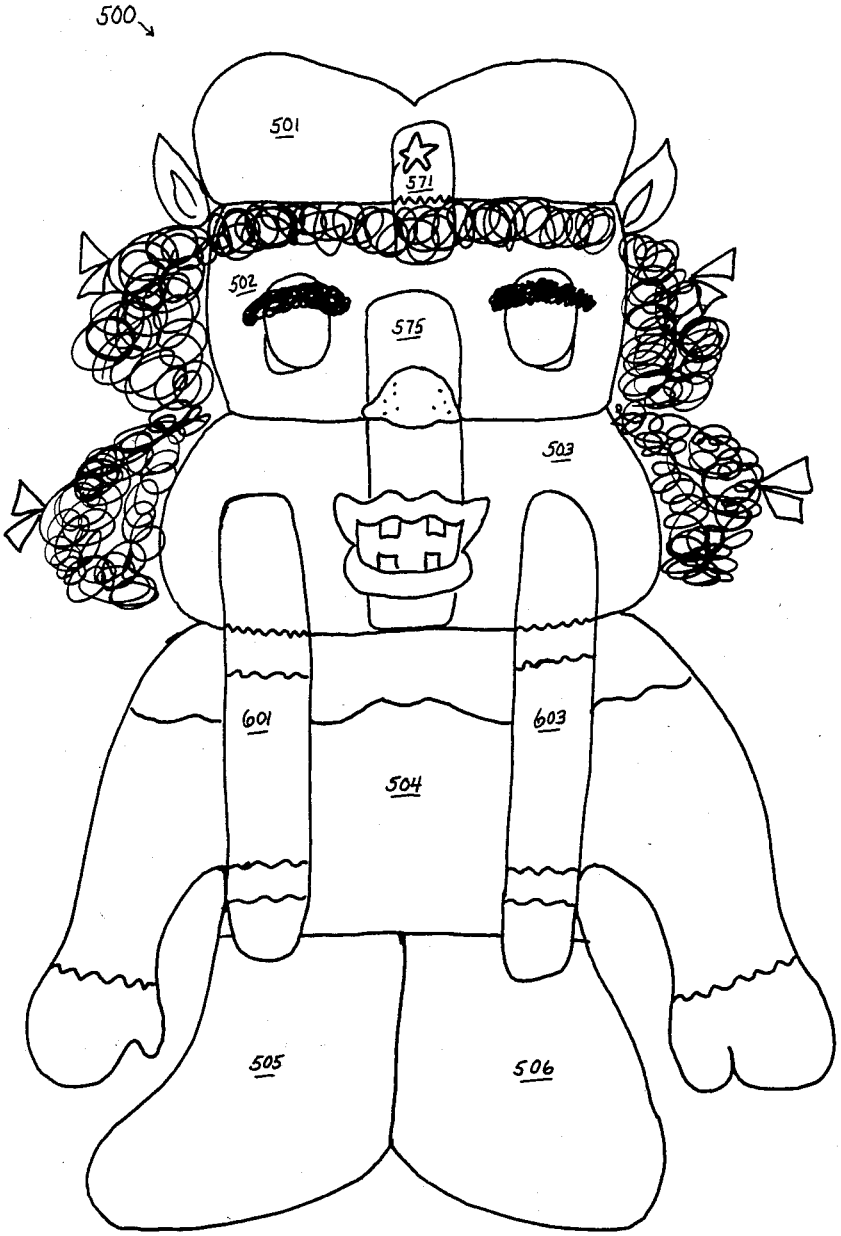
FIG. 6 is a front view of a doll representing a fanciful girl character in accordance with the invention.
Figure 7:
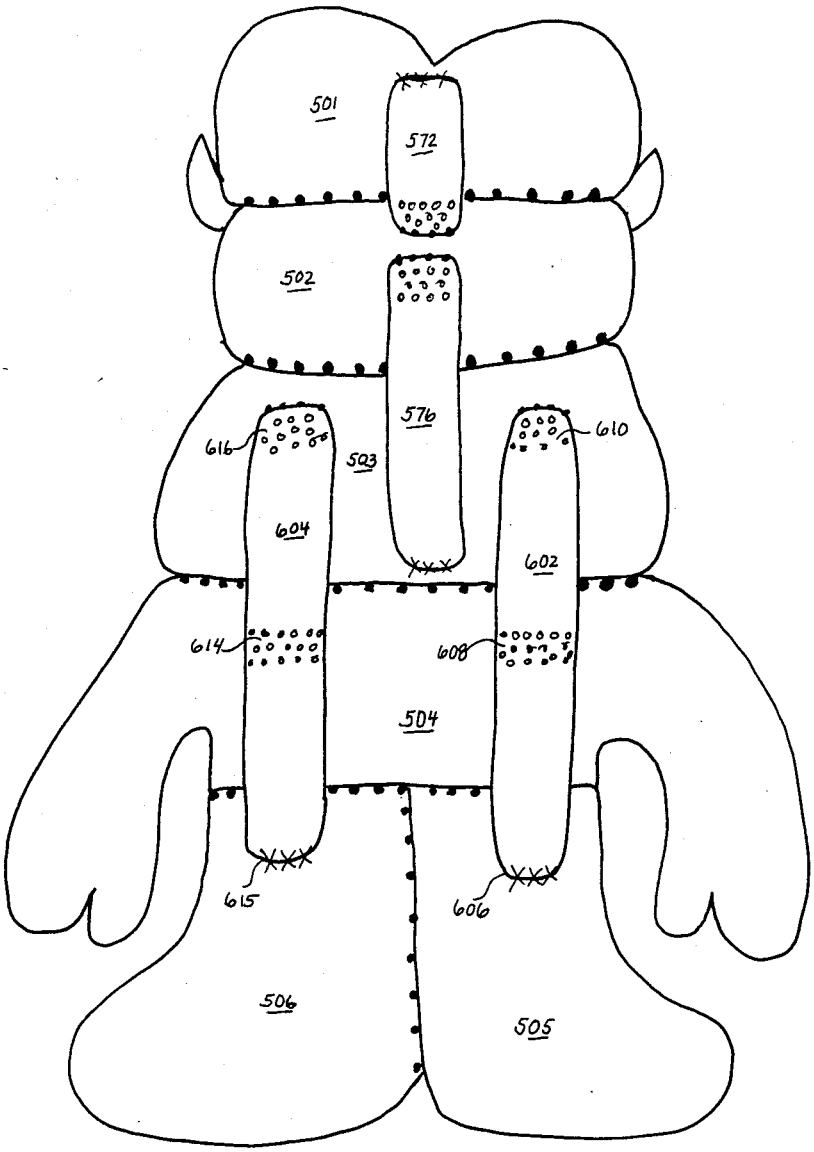
FIG. 7 is a back view of the doll of FIG. 6 depicted in the style of FIG. 2.

As shown in FIGS. 6 and 7, a doll 500 representing a girl humanoid character consists of six components 501, 502, 503, 504, 505, 506, which are similar in overall construction and detail to the previously described components of male doll 100 and female doll 300.

The head of the girl doll 500 is composed of a hat component 501, a brow component 502 and a cheek component 503, arranged from top to bottom in abutment.

The lower portion of the girl doll 500 is composed of a body component 504 and feet components 505 and 506. Supports 571 and 572 extend between components 501 and 502. Supports 575 and 576 extend between components 503 and 502. Support 575 is finished with a nose and mouth.

The feet components 505, 506 are affixed to extended supports 601, 602, 603, 604, which supports respectively are detachably secured to both body component 504 and to cheek component 503 by fastening tape as previously described. Thus, extended support 602 is affixed at stitching 606 to right foot component 505, and is detachably secured at fastening tape patch 608 to body component 504 and at fastening tape patch 610 to cheek component 503.

4. Boy Doll

Figure 8:
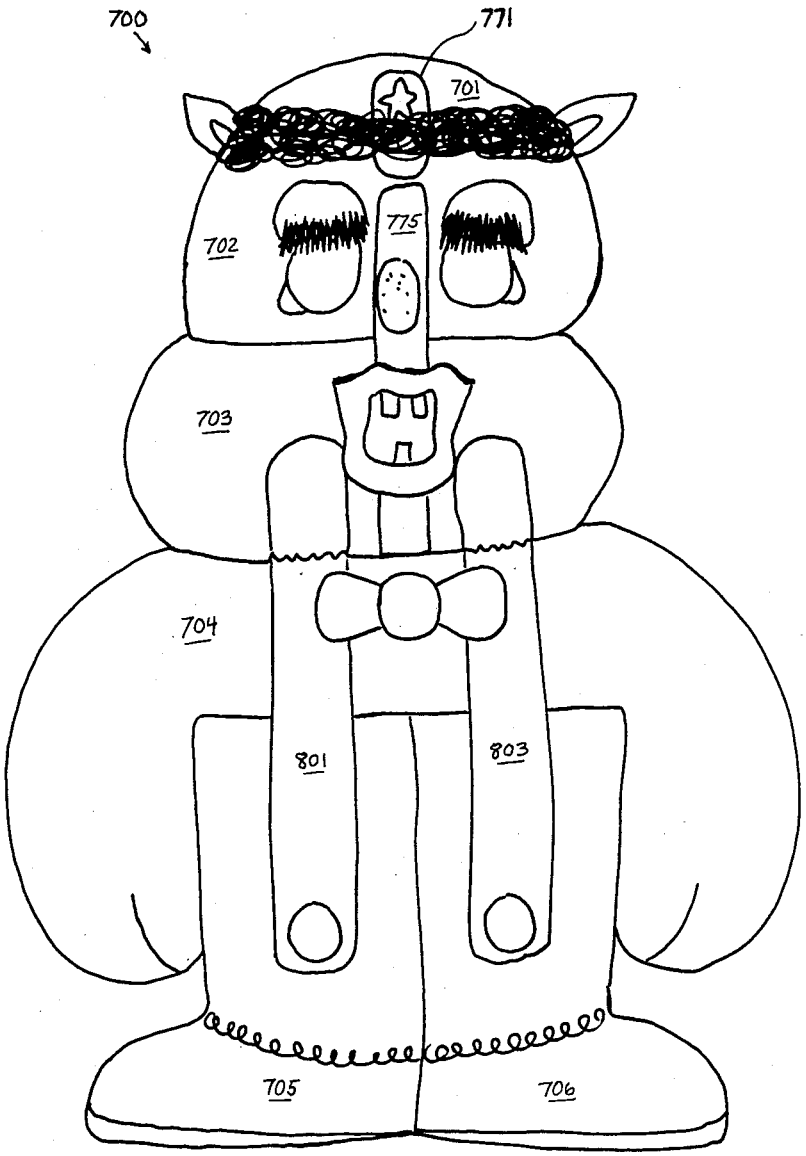
FIG. 8 is a front view of a doll representing a fanciful boy character in accordance with the invention.

As shown in FIG. 8, a doll 700 in accordance with the present invention depicting a humanoid boy character consists of six components 701, 702, 703, 704, 705, 706, which are similar in overall construction and detail to the previously described components of dolls 100, 300 and 500.

The head of the boy doll 700 is composed of a hat component 701, a brow component 702 and a cheek component 703, arranged from top to bottom in abutment.

The lower portion of the boy doll 700 is composed of a torso component 704 and leg components 705 and 706. The configuration of supports corresponds to that of the girl doll 500. Thus elements 801 and 803 (as well as 802 and 804, not shown) are extended supports corresponding to extended supports 601, 602, 603 and 604 on girl doll 500.

Figure 9:
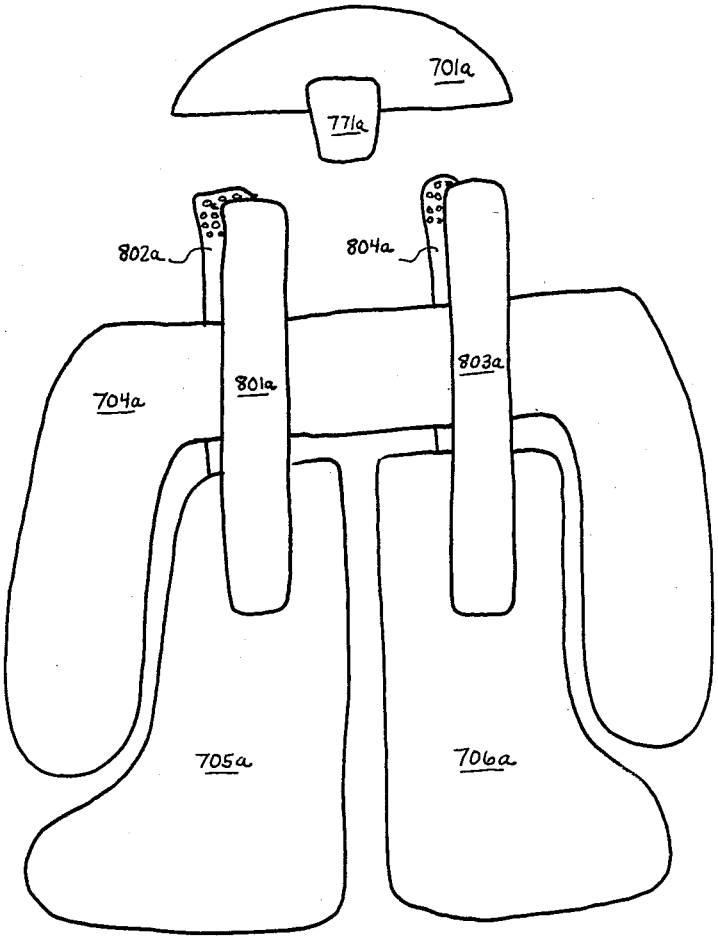
FIG. 9 is a view showing interchangeable parts representing a change of clothes of the doll of FIG. 8.

As shown in FIG. 9, interchangeable components (designated with the suffix (a) may be supplied to provide a change of clothes (as shown) or alternatively of facial characteristics (if components 702 and 703 are interchanged with other components). Such interchangeable components may be supplied for any of the embodiments of the present invention.

Having thus described my invention, what I desire to secure by Letters Patent and hereby claim is:

1. A figure toy comprising a plurality of components, (a) each component having front and back surfaces, an exterior edge surface and one or more interior edge surfaces, (b) each of said interior edge surfaces being detachably secured, by fastening tape on at least a portion of each of said interior edge surfaces, in abutting relationship with at least a portion of an interior edge surface of one or more of the other components, whereby the front surfaces of the components together define the front surface of the figure toy and the back surfaces of the components together define the back surface of the figure toy, (c) said toy further comprising a plurality of supports, a first of said supports overlying the front surface of the toy across the abutting interior edge surfaces of a pair of contiguous components, (d) one end of said first support being detachably secured to the front surface of one of the components and another end of said first support being secured to the front surface of another of said components, and (e) a second of said supports overlying the back surface of the toy across the abutting interior edge surfaces of a pair of contiguous components, (f) one end of said second support being detachably secured to the back surface of one of the components and another end of said second support being secured to the back surface of another of said components.

2. The figure toy of claim 1, wherein the figure is a representation of a fanciful humanoid character comprising a head and a body.

3. The figure toy of claim 2, consisting of at least six components, wherein at least three of said components define the head of said character.

4. The figure toy of claim 2, wherein said supports are straps, said toy further comprising representations of facial features permanently secured to the straps overlying the front surface of the components defining the head of the character.

5. The figure toy of claim 4, wherein the character is an adult male.

6. The figure toy of claim 4, wherein the character is an adult female.

7. The figure toy of claim 4, wherein the character is a girl.

8. The figure toy of claim 4, wherein the character is a boy.

9. The figure toy of claim 4, wherein one end of each strap is permanently affixed to one of the components.

10. The firgure toy of claim 1, wherein the supports are straps that are finished to match the portions of the front and back surfaces of the components which they respectively overlie.

11. The figure toy of claim 1, wherein the fastening tape is hook-and-eye tape.

12. A component for a figure toy, which toy comprises a plurality of said components, (a) said component having front and back surfaces, a surface intended to be an exterior edge surface of said toy, and one or more surfaces intended to be interior edge surfaces of said toy, (b) each of said interior edge surfaces being adapted to be detachably secured, by fastening tape on at least a portion of each of said interior edge surfaces, in abutting relationship with at least a portion of an interior edge surface of one or more of the other components, whereby the front surfaces of the components together define the front surface of the figure toy and the back surfaces of the components together define the back surface of the figure toy, (c) said component further comprising a plurality of supports, a first of said supports being adapted to overlie the front surface of the component across the abutting interior edge surfaces of a pair of contiguous components, (d) one end of said first support being affixed to the front surface of the component and another end of said first support being adapted to be detachably secured to the front surface of another of said components, and (e) a second of said supports being adapted to overlie the back surface of the toy across the abutting interior edge surfaces of a pair of contiguous components, (f) one end of said second support being affixed to the back surface of the component and another end of said second support being adapted to be secured to the back surface of another of said components.

13. The figure toy component of claim 12, wherein said component is adapted to interchange with a corresponding such component of a figure toy, whereby a change of design is effected.

14. The figure toy component of claim 12, wherein said figure toy is a representation of a fanciful humanoid character and the component represents an object of clothing of the character.

15. The figure toy component of claim 12, wherein said figure toy is a representation of a fanciful humanoid character comprising a head and a body and the component represents an element of the body of the character.

16. The figure toy component of claim 12, wherein said fastening tape is hook-and-eye tape.

17. A figure toy having a front surface and a back surface, said toy comprising a plurality of pillow-like components in a common plane, each component being detachably secured to another of the components by mating patches of fastening tape and each of a plurality of said components being reinforced in its attachment to at least one other component by a support strap secured thereto at one end and having at its other end a patch of fastening tape placed to mate with a corresponding patch of fastening tape on the other component.

18. The figure toy of claim 17, wherein the figure is a representation of a fanciful humanoid character comprising a head and a body.

19. The figure toy of claim 18, consisting of at least six components, wherein at least three of said components define the head of said character.

20. The figure toy of claim 18, further comprising representations of facial features permanently secured to a support strap overlying the front surface of the components defining the head of the character.

* * * * *